US006074032A

United States Patent [19]

Yokoi

[11] Patent Number: 6,074,032

[45] Date of Patent: Jun. 13, 2000

[54] RECORDING APPARATUS HAVING A PIVOTABLE MEMBER TO MAINTAIN A CONSTANT DISTANCE AND ANGLE BETWEEN A RECORDING HEAD AND A RECORDING MEDIUM

[75] Inventor: Katsuyuki Yokoi, Yokohama, Japan

[73] Assignee: Canon Kabushiki Kaisha, Tokyo, Japan

[21] Appl. No.: 08/672,024

[22] Filed: Jun. 26, 1996

[30] Foreign Application Priority Data

Jun. 30, 1995 [JP] Japan ..... 7-165350

[51] Int. Cl.[7] ..... B41J 25/308; B41J 2/01

[52] U.S. Cl. ..... 347/8; 347/104

[58] Field of Search ..... 347/3, 18, 33, 347/42, 108, 114, 8, 101, 104; 346/134, 140.1; 400/56, 58, 649, 656

[56] References Cited

U.S. PATENT DOCUMENTS 4,227,819 10/1980 Manriquez ..... 400/56
4,893,137 1/1990 Ebinuma et al. ..... 347/3
5,170,184 12/1992 Hanabusa et al. ..... 346/134

FOREIGN PATENT DOCUMENTS

037217A1 10/1981 European Pat. Off. .
1-182074 7/1989 Japan .

*Primary Examiner*—N. Le
*Assistant Examiner*—L. Anderson
*Attorney, Agent, or Firm*—Fitzpatrick,Cella, Harper & Scinto

[57] ABSTRACT

A recording apparatus for recording on a recording medium includes a conveyor rotating member rotatable for imparting a conveying force to the recording medium; a follower rotating member driven by rotation of the conveyor rotating member; and a recording area located downstream of the conveyor rotating member and the follower rotating member as viewed in the direction of conveyance of the recording medium for recording on a surface of the recording medium with which said follower rotating member comes into contact, wherein the position of the follower rotating member is fixed and the position of the conveyor rotating member is rockable. The recording apparatus can always maintain a recording device and a recording surface of a recording medium at constant distance and angle even if the thickness of the recording medium is changed, and perform an excellent recording.

7 Claims, 8 Drawing Sheets

RECORDING APPARATUS HAVING A PIVOTABLE MEMBER TO MAINTAIN A CONSTANT DISTANCE AND ANGLE BETWEEN A RECORDING HEAD AND A RECORDING MEDIUM

BACKGROUND OF THE INVENTION

1. Field of the Invention

The present invention relates to a recording apparatus for recording images on a recording medium by using recording means while supporting the recording medium in a recording area.

2. Description of the Related Art

Conventionally, a recording apparatus for recording on a recording medium by using recording means, such as a recording head, has been provided with a conveyor roller located upstream of a recording position of the recording head as viewed in the direction of conveyance of the recording medium, and a press-contact member pressed into contact with the conveyor roller so that the recording medium is nipped and conveyed by the press-contact member and the conveyor roller. And, the position of the conveyor roller is fixed, while the press-contact member is rockably pressed into contact with the conveyor roller. That is, the position of the surface of the recording medium conveyed by the conveyor roller is always fixed, and a surface of the press-contact member with respect to the recording medium is rocked.

Therefore, when the thickness of the recording medium is changed, the distance between the recording head and the recording surface of the recording medium is changed. In the case of a thick recording medium, such as an envelope, as compared with a thin recording medium, such as a cut paper, the distance between the recording head and the recording surface of the recording medium becomes a short distance so that recording quality may be changed and the recording medium may be caught by a carriage when a main scanning is performed with the cartridge.

Thus, a mechanism for maintaining the recording head and the recording surface of the recording medium at a constant distance as shown in FIGS. 8 and 9 has been conventionally introduced. FIG. 8 is a sectional view taken along a plane perpendicular to a main scanning direction of a so-called serial-type printer in which the recording head scans in the main scanning direction; and FIG. 9 is a partial view of the carriage viewed from the direction of arrow A as shown in FIG. 8.

Referring to these drawings, there are shown a carriage 101 having a recording head and scanning in the main scanning direction, a carriage shaft 102, a roller 103, a roller lever 104 holding the roller 103, a rail 105 provided parallel to the carriage shaft 102, a conveyor roller 106 for conveying the recording medium, a press-contact member 107 for pressing the recording medium into contact with the conveyor roller 106 to generate a conveying force, and a spring 108 provided between the roller lever 104 and the carriage 101.

By the action of the spring 108, the roller lever 104 and the roller 103 are pressed against the rail 105. By the reaction thereof, the carriage 101 receives a force of rotating clockwise in FIG. 8 about the carriage shaft 102. The carriage 101 is provided with a projection 101*a*, and the projection 101*a* is always kept in contact with the press-contact member 107 by the rotating force of the carriage 101 toward the press-contact member 107. For this reason, the recording head (not shown) mounted on the carriage 101 and the press-contact member 107 are always maintained at not less than the constant distance.

Therefore, since between the recording surface of the recording medium and the carriage 101, and further, the recording head are always maintained at not less than the constant distance even if the thickness of the recording medium is changed, the main scanning is always performed with the carriage 101 because the recording medium is not caught by the carriage 101.

However, in the conventional recording apparatus as described above, the distance between the carriage 101 rotating about the carriage shaft 102 and the press-contact member 107 is maintained by means of the projection 101*a* provided on the carriage 101. Thus, a rotation amount of the carriage 101 rotating counterclockwise in FIG. 8 about the carriage shaft 102 is changed when the thickness of the recording medium is changed. For this reason, the angle of the carriage 101, and the angle of the recording head with respect to the recording surface of the recording medium are changed although the amount of change is slight. Therefore, although a change in the thickness of the recording medium does not substantially affect recording to a recording medium of the same thickness, the recording position of the recording head with respect to the recording medium is slightly changed in accordance with the change of the thickness of the recording medium.

In addition, since the position of the projection 101*a* is closer to the carriage shaft 102 than the recording position of the recording head, variations in the length of the projection 101*a* are expanded so as to appear as variations in the distance between the recording head and the recording surface. For this reason, a predetermined distance between the recording head and the recording surface might be changed for each apparatus to vary recording quality for each apparatus.

Further, in order to maintain the predetermined distance between the recording head and the recording surface for the purpose of avoiding the above variations, the length of the projection 101*a* must be carefully managed. This leads to an increase in cost of the apparatus.

Still further, since the projection 101*a* is always pressed into contact with the holding member, it is worn out by friction when the main scanning of the carriage is repeated. As a result, the distance between the recording head and the recording surface might be changed during the use thereof for a long period of time.

SUMMARY OF THE INVENTION

It is an object of the present invention to provide a recording apparatus which can always maintain recording means and a recording medium at constant distance and angle even if the thickness of the recording medium is changed, and perform an excellent recording.

It is another object of the present invention to provide a recording apparatus wherein a recording means and a recording medium are always maintained at a constant distance and angle because a position of a follower rotating member in regard to the recording means is fixed, although the conveyor rotating member is rocked when the thickness of the recording medium is changed.

It is further object of the present invention to provide a recording apparatus for recording on a recording medium which comprises a conveyor rotating member rotatable for imparting a conveying force to the recording medium; a follower rotating member driven by rotation of the conveyor rotating member; and a recording area located downstream of the conveyor rotating member and the follower rotating member as viewed in the direction of conveyance of the recording medium for recording on a surface of the recording medium with which the follower rotating member comes into contact, wherein the position of the follower rotating member is fixed and the position of the conveyor rotating member is rockable.

DETAILED DESCRIPTION OF THE PREFERRED EMBODIMENTS

Figure 1:
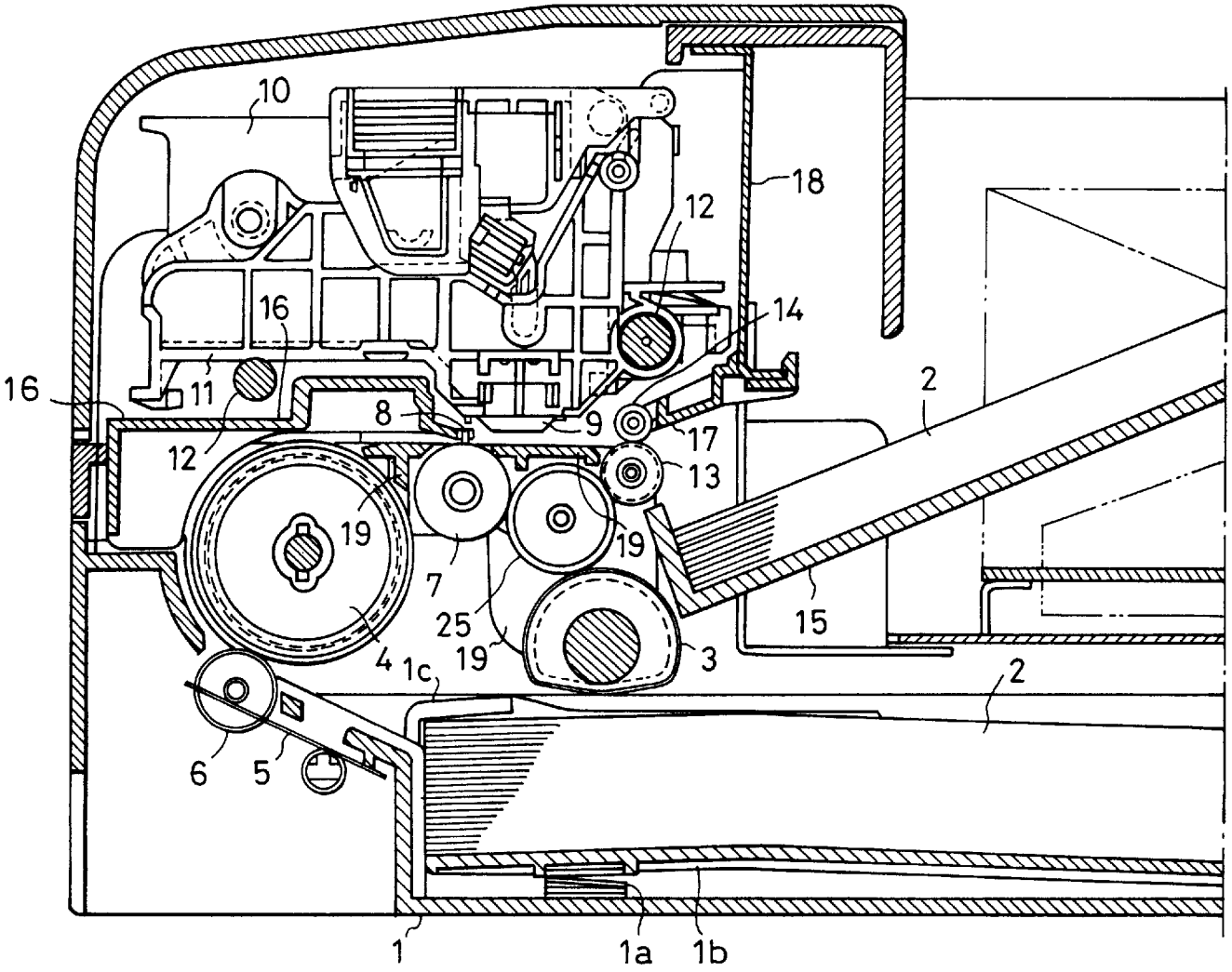
FIG. 1 illustrates a construction of a main part of an ink jet recording apparatus according to an embodiment of the present invention.
Figure 2:
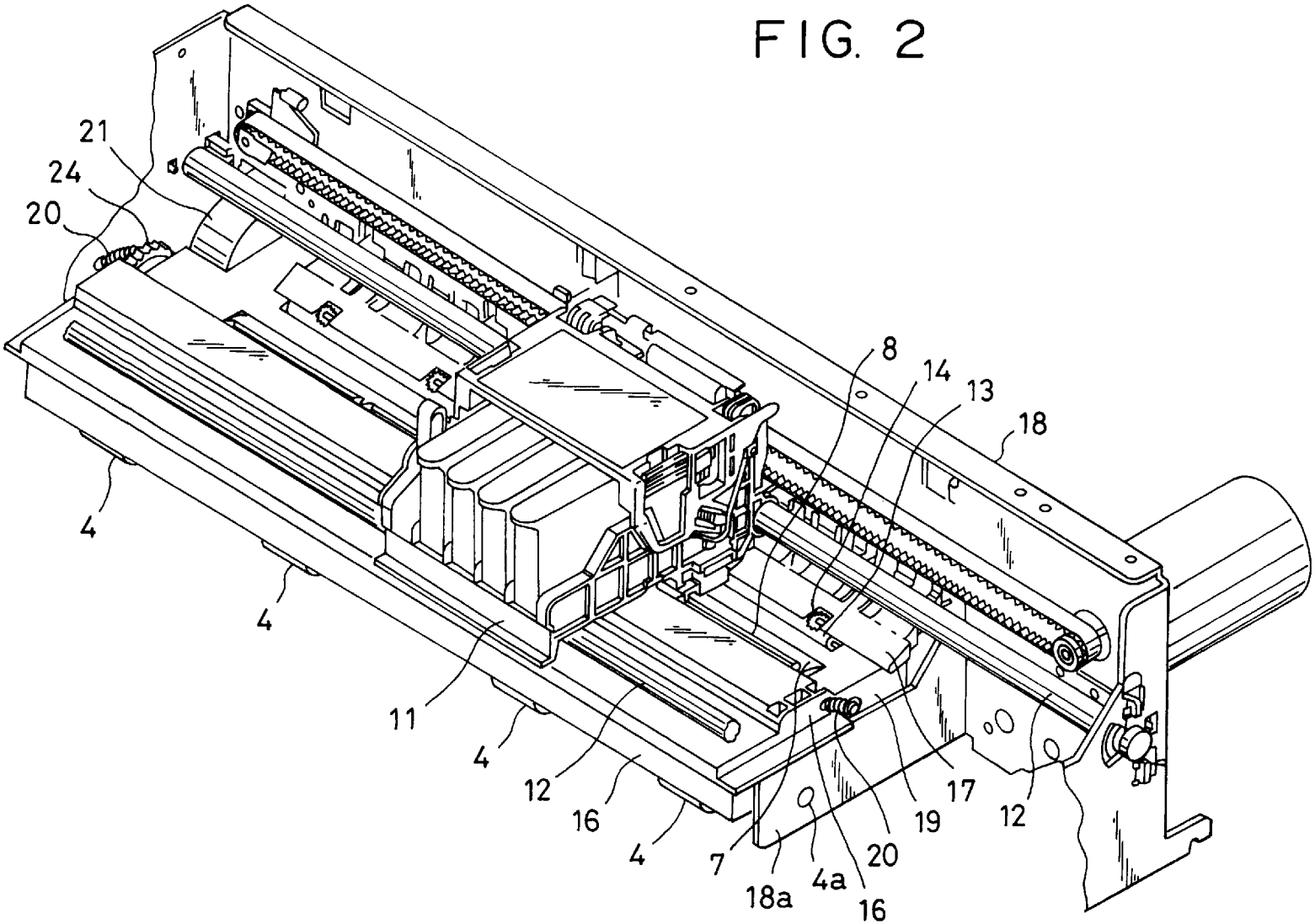
FIG. 2 is a perspective view which illustrates a section around a carriage including a recording area.
Figure 3:
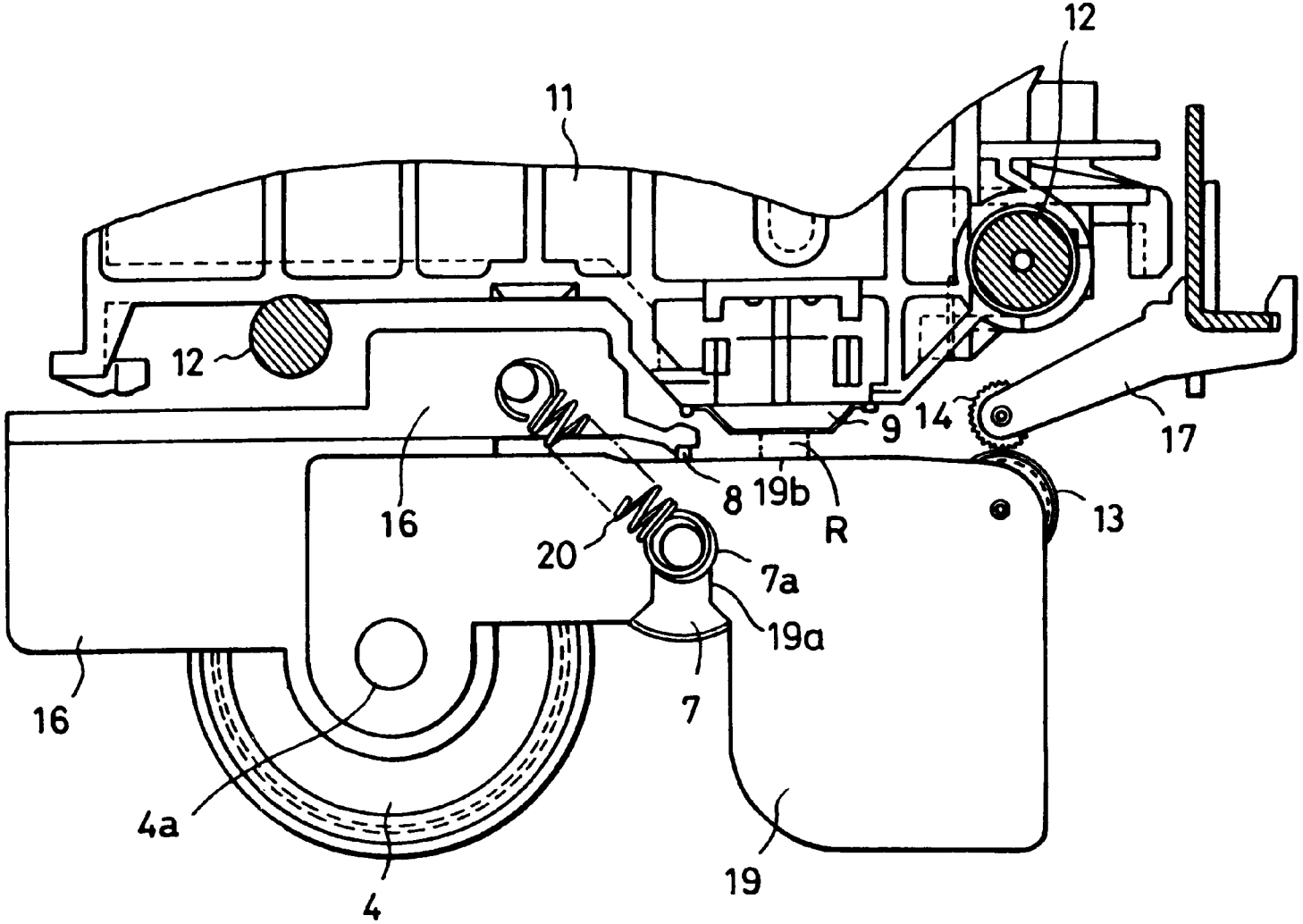
FIG. 3 illustrates a rocking structure of a conveyor roller.
Figure 4:
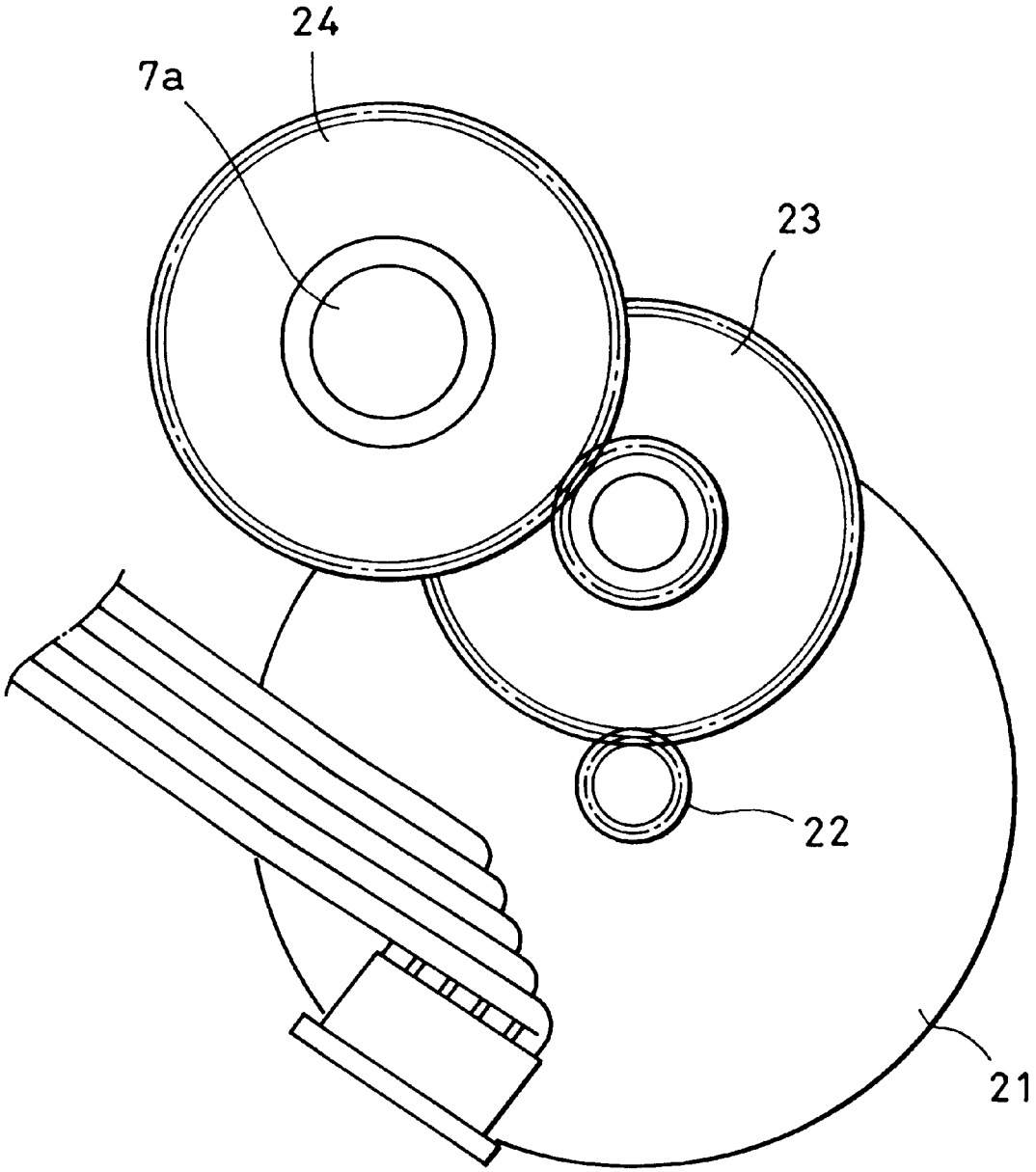
FIG. 4 illustrates a construction for transmitting a driving force to the conveyor roller.

A first embodiment of a recording apparatus according to the present invention will now be described with reference to the accompanying drawings. FIG. 1 illustrates a construction of a main part of the recording apparatus; FIG. 2 is a perspective view which illustrates a section around a carriage including a recording area; FIG. 3 illustrates a rocking structure of conveyor rollers; and FIG. 4 illustrates a driving force transmission mechanism.

Taking an ink jet recording apparatus as an example of the recording apparatus according to the present invention, an overall construction of the apparatus will be first described, and a rocking structure of the conveyor rollers will be next described.

(Overall construction of the apparatus)

The recording apparatus is of a ink jet recording method. A cassette 1 is detachably mounted to the bottom of the apparatus, and a plurality of recording mediums 2 are stacked and held on a pressure plate 1*b* which is urged by a pressing spring 1*a* of the cassette 1. The recording mediums 2 are separated and fed one at a time by a feed roller 3 and a separator lug 1*c* provided on the upper portion of the tip of the cassette 1, and are reversed and conveyed by a reverse roller 4 and a press-contact roller 6 which is pressed into contact with the roller 4 by means of a plate spring 5. Then, the recording mediums 2 are nipped by a conveyor roller 7, which is a first conveyor rotating member to be driven for rotation, and a first follower roller 8, driven by rotation of the conveyor roller 7 so as to be conveyed to a recording position located downstream of the nipped position as viewed in the direction of conveyance of the recording medium.

In a recording area R (in this embodiment, a space where ink ejected from a recording head 9 is allowed to fly) where recording is performed on the recording medium, the recording head 9 constituting recording means is mounted on a carriage 11 together with an ink tank 10 at a position opposite to the recording medium. The carriage 11 is reciprocable in a main scanning direction along two carriage shafts 12 provided parallel to each other in the direction crossing the conveyance direction of the recording medium, for example, in the direction crossing the conveyance direction of the recording medium substantially at right angles (the vertical direction of a plane of FIG. 1). The recording head 9 ejects ink in response to an image signal when the carriage 11 reciprocates to perform a predetermined recording on the recording medium 2.

An ink ejection structure of the recording head 9 of the ink jet method used in this embodiment includes commonly a fine liquid ejection ports (orifices), a liquid path, an energy active section provided in a portion of the liquid path, and energy generation means for generating liquid droplet-forming energy which is acted on the liquid in the active section.

Examples of energy generation means for generating such energy include an electrical-mechanical conversion member such as piezoelectric element, energy generation means for generating heat by irradiation with electromagnetic wave such as laser, and for ejecting liquid droplets by the action of heat generation, and energy generation means for ejecting liquid by heating the liquid with an electrical-thermal conversion member such as a heating element having a heating resistor.

A recording head used in an ink jet recording method in which liquid is ejected by thermal energy can arrange orifices for ejecting recording liquid droplets in high density. Therefore, high-resolution recording can be performed. Particularly, the recording head using the electro-thermal conversion member has the following advantages. The recording head can be easily reduced in size. The recording head can sufficiently utilize recent advanced technology in the field of semiconductor, and advantages of IC technology and microtechnology in which reliability is remarkably increased. The recording head can be easily mounted in high density. And, the recording head can be manufactured at a low cost.

In this embodiment, the recording head has a lot of nozzles. Electro-thermal conversion elements provided in the nozzles selectively generate heat, so that ink is ejected from orifices formed at the tip of the nozzles by a film-boiling pressure generated in the ink to from an ink image on the recording medium 2.

Further, in this embodiment, not only a serial-type recording apparatus in which a carriage as the head mounting section is serially moved, but also a recording apparatus in which a recording head of so-called a full line type having recording elements (such as orifices and heating elements) over the entire width of a recording medium in the direction of intersecting the conveyance direction of the recording medium may be employed.

The recording medium 2 on which an image is recorded by the recording head 9 is nipped and conveyed by a second conveyor roller 13 and a second follower roller 14 to be discharged to a discharge stacker 15. The second conveyor roller 13 is a second conveyor rotating member which is located downstream of the recording position of a rocking member surface 19*b* in regard to the head in the recording area R of the recording medium as viewed in the direction of conveyance of the recording medium. The second follower roller 14 is driven by rotation of the roller 13.

The first follower roller 8 is rotatably mounted to a first holding member 16, and the second follower roller 14 is rotatably mounted to a second holding member 17. The first and second holding members 16 and 17 are fixed to a chassis 18, and the carriage shafts 12 are also fixed to the chassis 18. Therefore, the positions of the first and second follower rollers 8 and 14 in the heightwise direction of the apparatus are always constant with respect to the recording head 9.

On the other hand, the first and second conveyor rollers 7 and 13 are rockably mounted in the heightwise direction of the apparatus with respect to the recording head 9.

(Rocking structure of the conveyor rollers)

The rocking structure of the first and second conveyor rollers 7 and 13 will now be described. FIG. 3 is a right side view in which a chassis side plate 18*a* supporting a roller shaft 4*a* shown in FIG. 2 is removed. As shown in FIG. 3, a rocking member 19 is pivotably mounted about the roller shaft 4*a* of the reverse roller 4, and a roller shaft 7*a* of the conveyor roller 7 is fitted into a reversed U-shaped groove 19*a* which is formed in the rocking member 19. A tension spring 20 as an elastic member is locked between both ends of the roller shaft 7*a* and the first holding member 16. As a result, the rocking member 19 is urged to pivot counterclockwise about the reverse roller shaft 4*a*, and the first conveyor roller 7 is pressed into contact with the first follower roller 8. The spring 20 may be provided at several sections of the portion in the direction of the length of the first conveyor roller 7 other than an area through which paper passes.

In addition, the second conveyor roller 13 is mounted to the rocking member 19 and abuts against the second follower roller 14 when the rocking member 19 is urged counterclockwise as described above.

The first and second conveyor rollers 7 and 13 are driven by rotation so as to impart a conveying force to the recording medium 2. A driving force transmission mechanism is constructed as shown in FIG. 4.

Referring to FIG. 4, a motor gear 22 attached to a drive shaft of a motor 21 is meshed with an idler gear 23, which is a first driving force transmission member, and the idler gear 23 is meshed with a roller gear 24 attached to the roller shaft 7*a* of the first conveyor roller 7, so that driving force of the motor 21 is transmitted to the first conveyor roller 7.

In addition, as shown in FIG. 1, a transmission roller 25, which is a second driving force transmission member, is pressed into contact with the first and second conveyor rollers 7 and 13 by means of a spring (not shown). A driving force of the first conveyor roller is transmitted to the second conveyor roller 13 through the transmission roller 25.

The motor 21, idler gear 23 and transmission roller 25 are mounted to the rocking member 19 so that the driving force can be transmitted even if the first and second conveyor rollers 7 and 13 are rocked by the action of the rocking member 19.

In such a construction as described above, as represented by the following equation, a value of a press-contacting force at a press-contacting position can be obtained by dividing a difference between a moment around the rocking center (i.e., reverse roller shaft) 4*a* of the rocking member 19 due to the resilient force of the spring 20 and a moment around the rocking center 4*a* of the rocking member 19 due to weight of each member mounted to the rocking member 19 by a distance between the rocking center 4*a* and a press-contacting point of the first conveyor roller 7 and the first follower roller 8.

$$\text{Press-contacting force} = \frac{\text{(Moment of resilient force of spring)} - \text{(Sum of Moment of weight of member)}}{\text{Distance between rocking center and press-contacting point}}$$

Therefore, by selecting the resilient force of the spring 20 fitted to both right and left ends of the rocking member 19 in consideration of the position of the member, such as a motor, to be mounted to the rocking member 19, the press-contacting force which is most suitable for conveying the recording medium can be set while maintaining a balance between the right and left portion of the rocking member 19.

In addition, if the resilient force of the spring 20 is set within its allowable stress, a desired press-contact force can be obtained for a long period of time without deformation of the spring itself.

Figure 5:
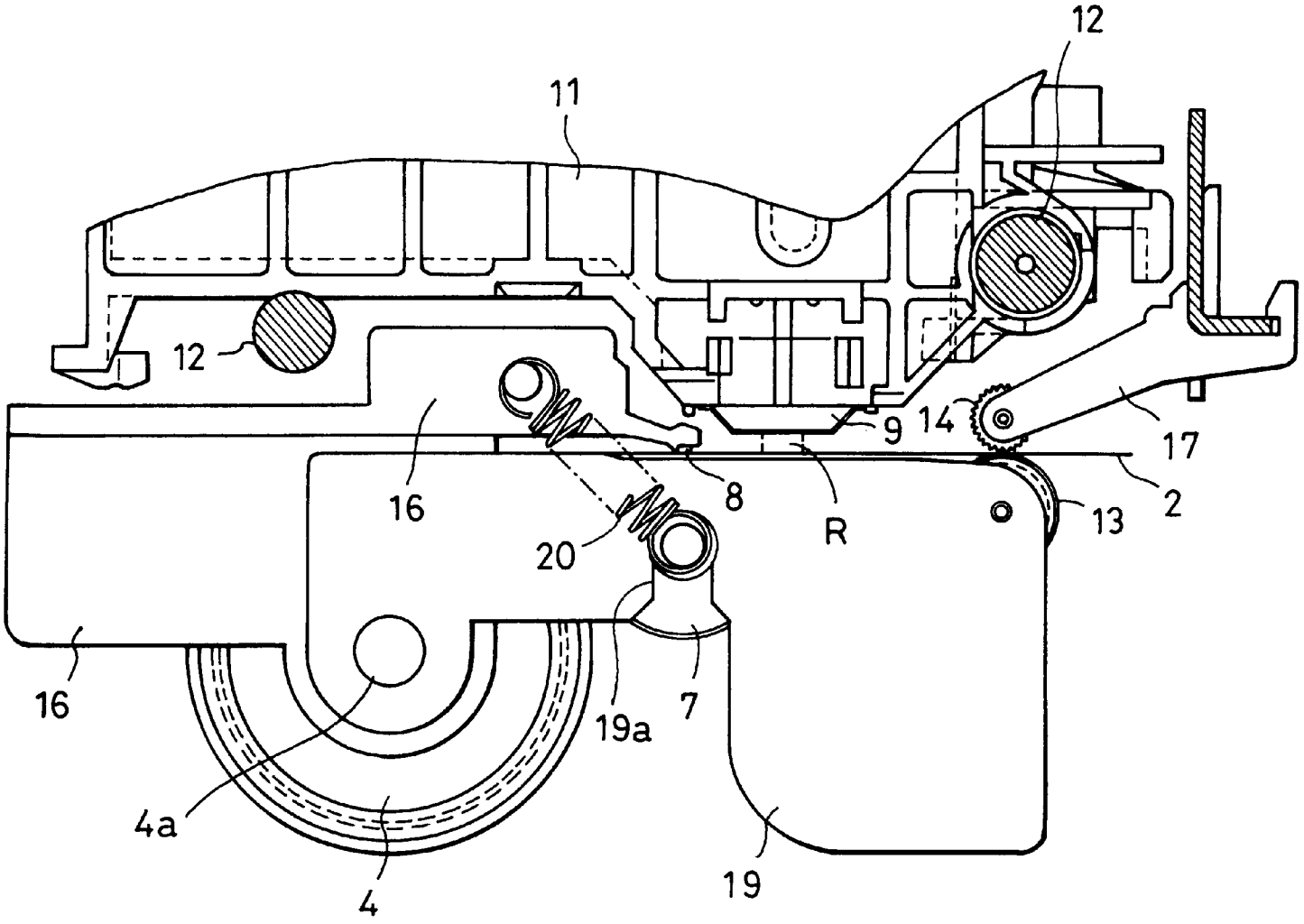
FIG. 5 illustrates a case where a thin recording medium is conveyed.
Figure 6:
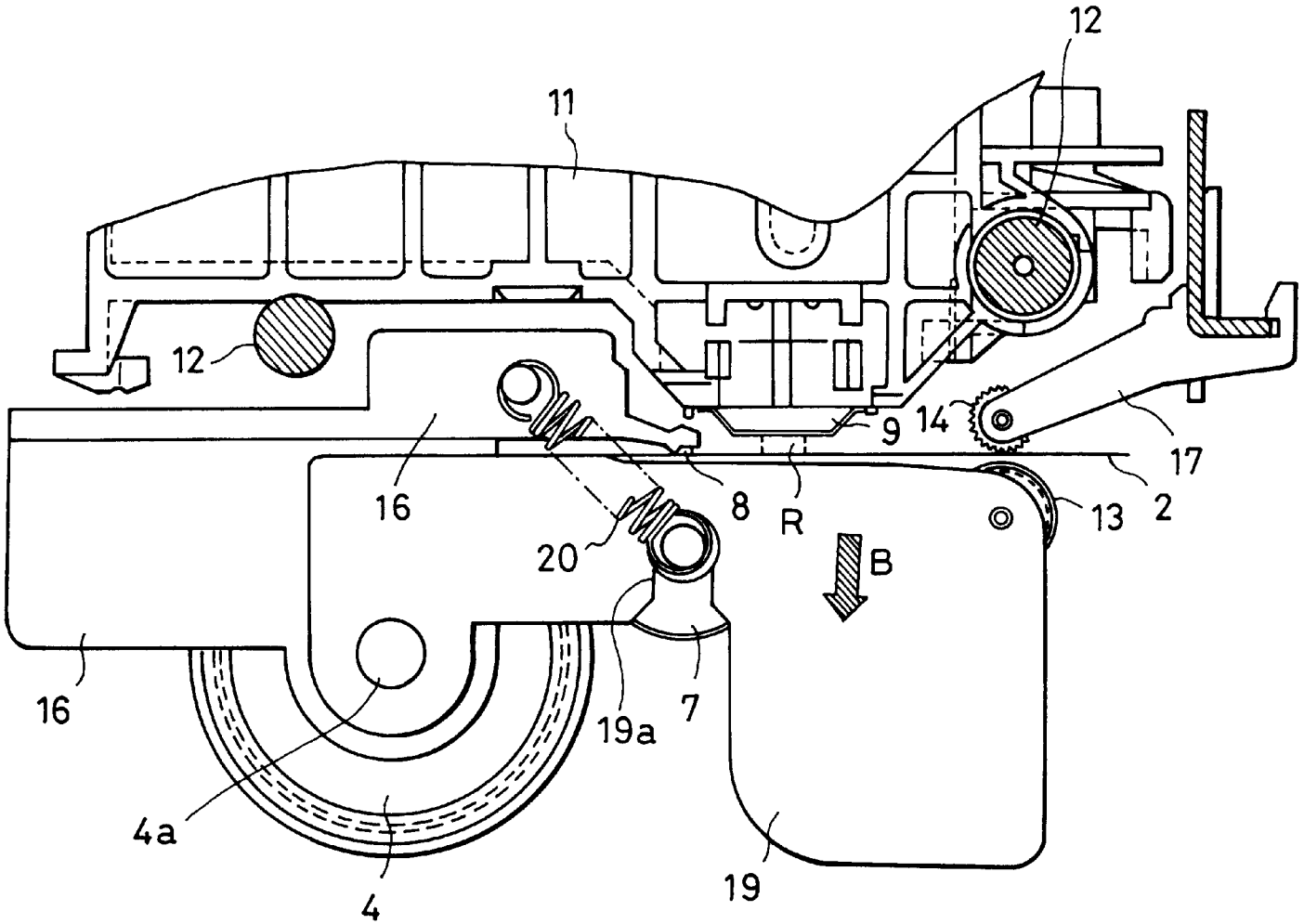
FIG. 6 illustrates a case where a thick recording medium is conveyed.

In the construction as described above, when a thick recording medium 2 is conveyed (see FIG. 6), as compared with conveying of a thin recording medium 2 (see FIG. 5), the first conveyor roller 7 moves substantially downwards in the direction of arrow B, and the second conveyor roller 13 is also moved in this direction because the rocking member 19 is caused to pivot downwards around roller shaft 4*a* when the first conveyor roller 7 so moves. As a result, the recording medium 2 is securely nipped and conveyed by the first and second conveyor rollers 7 and 13 and the first and second follower rollers 8 and 14 even if the thickness of the recording medium 2 is changed. At this time, the positions of the first and second follower rollers 8 and 14 which come into contact with a recording surface of the recording medium 2 are fixed, and the positions are not changed with respect to the carriage shaft 12. For this reason, the recording surface of the recording medium 2 and the recording head 9 mounted on the carriage 11 are always maintained at constant distance and angle even if the thickness of the recording medium 2 is changed, whereby an image of high quality can be recorded.

In addition, the recording head 9 and the recording surface of the recording medium 2 are not positioned by members relating to the main scanning as in the conventional recording apparatus. Therefore, a problem concerning durability does not arise, thereby always obtaining an excellent image for a long period of time.

Further, the distance between the recording head 9 and the recording surface of the recording medium 2 can be easily set by merely positioning the holding members 16 and 17 which hold the first and second follower rollers with respect to the chassis 18.

Still further, the position of the first follower roller 8 located in regard to the recording head 9 with the recording medium therebetween is fixed, and the first conveyor roller 7 located substantially opposite the recording head 9 is movable. Thus, the diameter of the first follower roller 8 can be freely selected because it does not directly affect on the degree of conveyance accuracy as would the first conveyor roller 7. Therefore, by selecting a first follower roller 8 of a smaller diameter, the distance between the recording head 9 and the recording surface of the recording medium 2 can be located at a position nearer to the recording head, so that the distance accuracy between the recording head and the recording surface of the recording medium 2 can be further increased. In addition, the recording medium 2 is held by the press-contacting point of the first follower roller 8 and the first conveyor roller 7 while obtaining the effect of maintaining the distance between the recording head 9 and the recording medium 2, thereby increasing a recordable area.

In addition, the diameter of the first conveyor roller 7, located at the substantially opposite area to the recording head 9 with the recording medium 2 therebetween is not limited. Thus, that and more diameter can be selected for the preferred degree of conveyance accuracy, so that the conveyance accuracy can be further increased. Therefore, it is also possible to record a higher-quality image.

Figure 7:
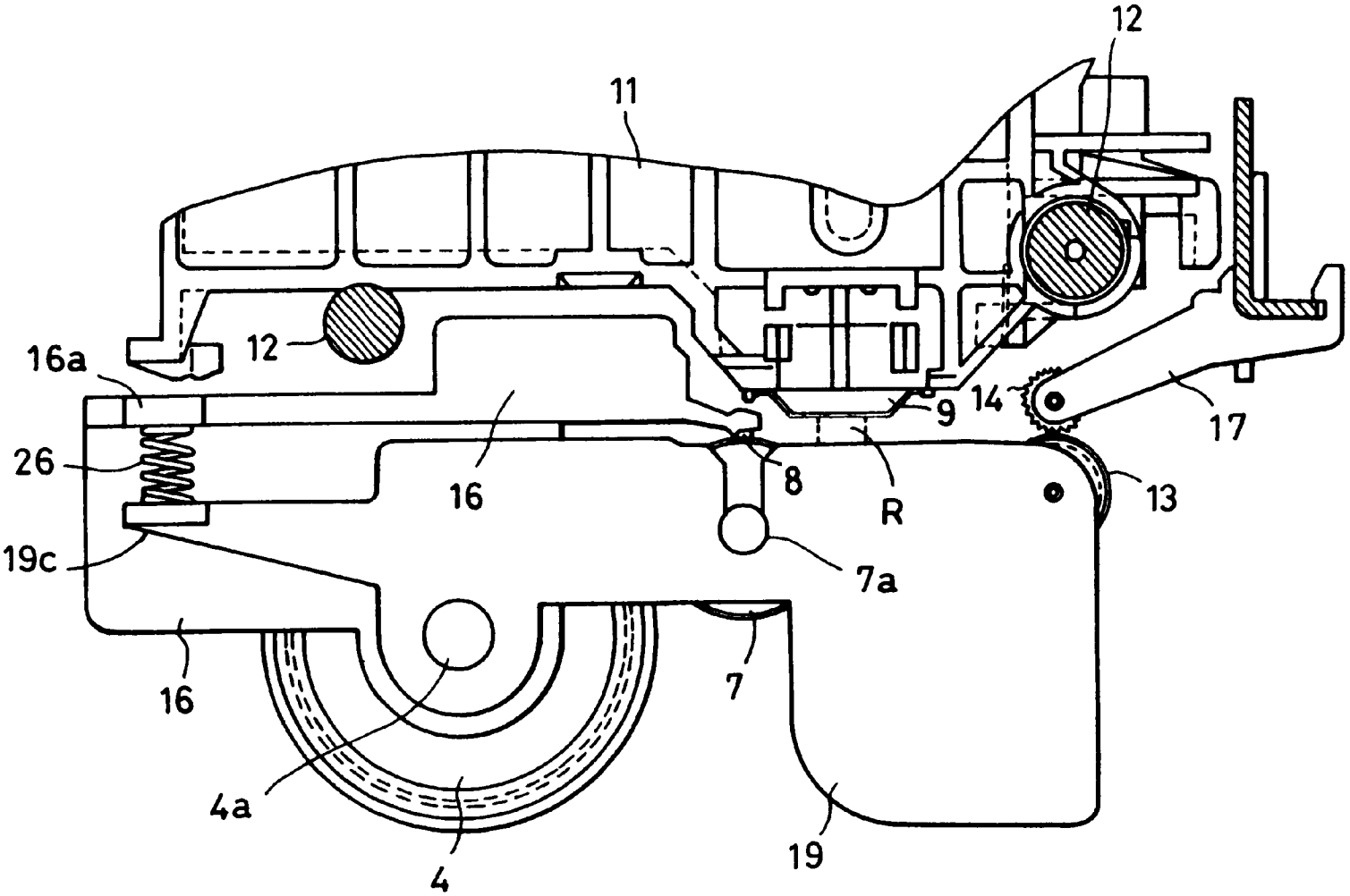
FIG. 7 illustrates a rocking structure of another embodiment of a recording apparatus according to the present invention.
Figure 8:
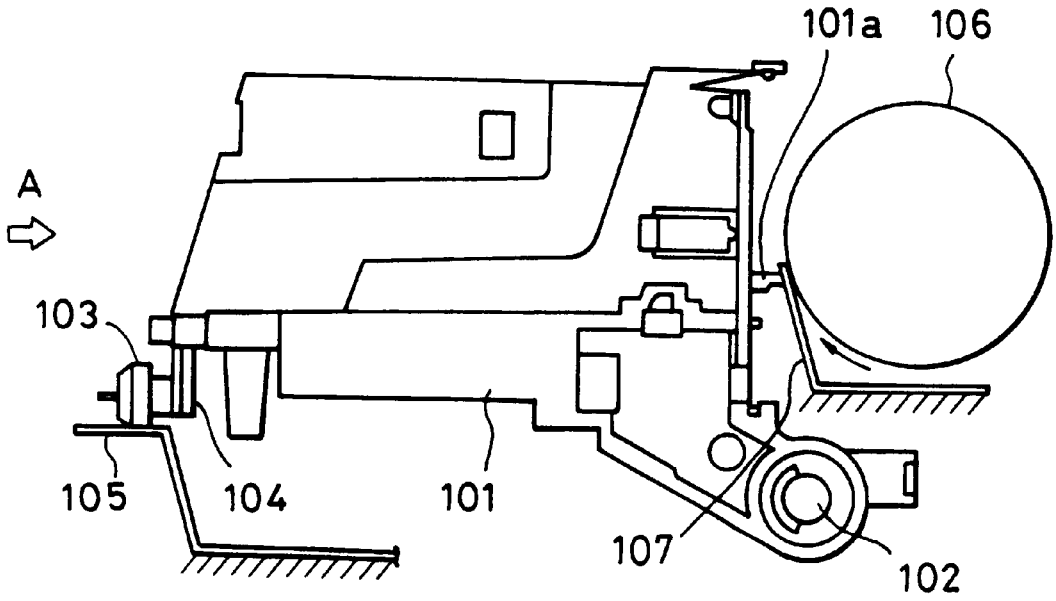
FIG. 8 PRIOR ART
FIG. 8 illustrates a section around a carriage of a conventional recording apparatus.
Figure 9:
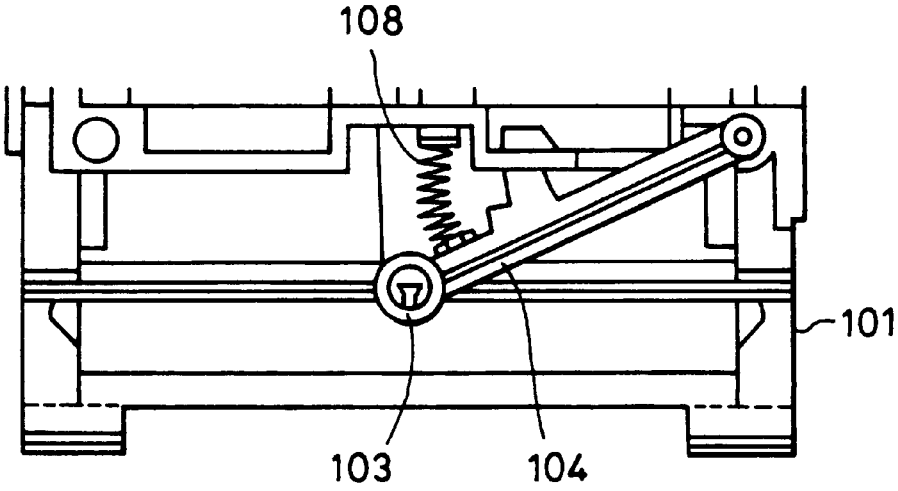
FIG. 9 PRIOR ART
FIG. 9 is a partial view of the carriage of FIG. 8.

FIG. 7 illustrates a second embodiment of a recording apparatus according to the present invention. In the recording apparatus of this embodiment, a spring seat 19*c* is provided on the opposite side to the first conveyor roller 7 with the reverse roller shaft 4*a* (i.e., the center of pivoting of the rocking member 19) therebetween, a compression spring 26 as an elastic member is provided between the spring seat 19*c* and the opposing section 16*a* of the first holding member 16 to allow the first conveyor roller 7 to be pressed into contact with the first follower roller 8. This differs from the construction of the first embodiment in which the first conveyor roller shaft 7*a* and the driven roller holding member 16 are connected by the tension spring 20 to allow the first conveyor roller 7 to be pressed into contact with the first follower roller 8.

The construction as described above offers the same advantages as those of the construction of the first embodiment.

Although the ink jet recording method is described in the above embodiments, the recording method is not limited thereto, and other recording methods may be employed. In addition, the conveyor rotating members and driven rotating members are not limited to roller-like members as in described in the embodiments. Even if a rotation belt or the like is used as the above rotating member, the same advantages as those of the embodiments can be provided.

As described above, according to the embodiments, the positions of the follower rotating members, for example rollers which come into contact with the recording surface in regard to the recording means are fixed, and the positions of the conveyor rotating members, for example rollers, are movable. Therefore, even if the thickness of the recording medium is changed, the recording means and the recording surface of the recording medium are always maintained at constant distance and angle. Accordingly, even by a recording apparatus like a recording apparatus of an ink jet recording method, which requires an accurate setting of the positions of the recording medium and the recording means, a high-quality image can be obtained.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A recording apparatus using a recording head for recording on a recording medium, said recording apparatus comprising:

a pivotable member having a surface positioned opposite the recording head and over which the recording medium is conveyed in a conveyance direction from upstream of the recording head to downstream of the recording head;

a first follower member provided upstream of the recording head and facing a recording side of the recording medium;

a first conveyor roller engaging said pivotable member, provided upstream of the recording head and facing a non-recording side of the recording medium, wherein said first conveyor roller and said first follower member nip and convey the recording medium toward the surface of said pivotable member;

a second follower member provided downstream of the recording head and facing the recording side of the recording medium;

a second conveyor roller engaging said pivotable member, provided downstream of the recording head and facing the non-recording side of the recording medium, wherein said second conveyor roller and said second follower member nip and convey the recording medium away from the surface of said pivotable member; and moving means for allowing said pivotable member, together with said first and second conveyor rollers, to pivot further away from the recording head as a thickness of the recording medium increases.

2. A recording apparatus according to claim 1, wherein said recording head is an ink jet recording head.

3. A recording apparatus according to claim 2, wherein said ink jet recording head includes an electro-thermal conversion member which generates energy for ejecting ink from ink ejection ports.

4. A recording apparatus according to claim 1, further comprising a reverse roller to convey the recording medium to said first conveyor roller, wherein said moving means allows said pivotable member to pivot around the axis of the reverse roller in a direction substantially perpendicular to the conveyance direction.

5. A recording apparatus according to claim 1, further comprising a first holding member for holding said first follower member, wherein said moving means comprises a spring connected between the first conveyor roller and said first holding member.

6. A recording apparatus according to claim 1, further comprising a spring seat extending from said pivotable member and a first holding member for holding said first follower member, wherein said moving means comprises a spring connected between said spring seat and said first holding member.

7. A recording apparatus according to claim 1, further comprising a driving force transmission mechanism for transmitting respective driving forces to said first and second conveyor rollers to cause them to convey the recording medium, wherein said driving force transmission mechanism also engages said pivotable member.

* * * * *

UNITED STATES PATENT AND TRADEMARK OFFICE

CERTIFICATE OF CORRECTION

PATENT NO. : 6,074,032

DATED : June 13, 2000

INVENTOR(S) : KATSUYUKI YOKOI

It is certified that error appears in the above-identified patent and that said Letters Patent is hereby corrected as shown below:

ON THE COVER PAGE:

Under Column [73], Assignee, insert:

--[*] Notice: This patent issued on a continued prosecution application filed under 37 CFR 1.53(d), and is subject to the twenty year patent term provisions of 35 U.S.C. 154(a)(2).--.

COLUMN 2

Line 63, "It is" should read --It is a--.

COLUMN 3

Line 44, "first described" should read --described first--;
Line 45, "next" should read --described--;
Line 46, "described" should read --next--; and
Line 48, "a" should read --an--.

COLUMN 4

Line 15, "ports" should read -port--;
Line 22, as" should read --as a--;
Line 23, "with" should read --with an--;
Line 24, "as" should read --as a--; and
Line 46, "from" should read --form--.

UNITED STATES PATENT AND TRADEMARK OFFICE

CERTIFICATE OF CORRECTION

PATENT NO. : 6,074,032

DATED : June 13, 2000

INVENTOR(S) : KATSUYUKI YOKOI

It is certified that error appears in the above-identified patent and that said Letters Patent is hereby corrected as shown below:

COLUMN 5

Line 43, "that" should read --that the--.

COLUMN 7

Line 6, "and more" should be deleted;
Line 32, "ind" should be deleted; and
Line 38 "rollers" should read --rollers,--.

Signed and Sealed this

Twenty-fourth Day of April, 2001

*Attest:*

Nicholas P. Godici

NICHOLAS P. GODICI

*Attesting Officer*

*Acting Director of the United States Patent and Trademark Office*